US007876212B2

(12) United States Patent
Jones

(10) Patent No.: US 7,876,212 B2
(45) Date of Patent: Jan. 25, 2011

(54) SECURITY SYSTEM

(75) Inventor: Kevin Jones, 27 Henry Road, Oxford, OX2 0DG, Oxfordshire (GB)

(73) Assignee: Kevin Jones, Oxfordshire (GB)

( * ) Notice: Subject to any disclaimer, the term of this patent is extended or adjusted under 35 U.S.C. 154(b) by 313 days.

(21) Appl. No.: 12/161,273

(22) PCT Filed: Jan. 15, 2007

(86) PCT No.: PCT/GB2007/050018

§ 371 (c)(1),
(2), (4) Date: Sep. 15, 2008

(87) PCT Pub. No.: WO2007/083161

PCT Pub. Date: Jul. 26, 2007

(65) Prior Publication Data

US 2009/0243838 A1 Oct. 1, 2009

(30) Foreign Application Priority Data

Jan. 19, 2006 (GB) ..... 0601075.5
Feb. 7, 2006 (GB) ..... 0602394.9

(51) Int. Cl.
*G08B 1/08* (2006.01)

(52) U.S. Cl. ..... 340/538; 340/531; 340/310.11

(58) Field of Classification Search ..... 340/538, 340/538.15, 538.17, 531, 534, 310.11, 310.16, 340/310.18, 539.1; 455/404.1, 404.2; 709/201, 709/238

See application file for complete search history.

(56) References Cited

U.S. PATENT DOCUMENTS 4,978,946 A * 12/1990 Nordholm et al. ..... 340/573.1
5,381,136 A * 1/1995 Powers et al. ..... 340/539.26
5,714,933 A 2/1998 Le Van Suu
6,995,666 B1 * 2/2006 Luttrell ..... 340/539.1
7,194,249 B2 * 3/2007 Phillips et al. ..... 455/404.1
7,274,305 B1 * 9/2007 Luttrell ..... 340/870.02
7,389,104 B2 * 6/2008 Phillips et al. ..... 455/404.1
7,689,711 B2 * 3/2010 Brouk et al. ..... 709/238
7,788,399 B2 * 8/2010 Brouk et al. ..... 709/238

FOREIGN PATENT DOCUMENTS

| | | |
|---|---|---|
| EP | 0852367 A2 | 7/1998 |
| FR | 2 854 712 | 11/2004 |
| GB | 2 229 025 | 9/1990 |
| GB | 2 233 485 | 1/1991 |
| WO | 2004/010395 | 1/2004 |
| WO | 2005/092024 | 10/2005 |

OTHER PUBLICATIONS

International Search Report for corresponding Application No. PCT/GB2007/050018 mailed Apr. 12, 2007.

British Search Report for corresponding Application No. GB0601075.5 dated Apr. 28, 2006.

* cited by examiner

*Primary Examiner*—Van T. Trieu
(74) *Attorney, Agent, or Firm*—Renner, Otto, Boisselle & Sklar, LLP

(57) ABSTRACT

There is provided a security system for an electrical device connected to a mains electricity supply, the security system comprising a confirmation transmitter interposed between the electrical device and the mains electricity supply. The transmitter is arranged to send a confirmation message via the mains supply to a control unit that is operatively connected to the mains supply. The control unit is arranged to activate an alarm if the control unit does not receive the confirmation message.

24 Claims, 4 Drawing Sheets

SECURITY SYSTEM

CROSS-REFERENCE TO RELATED APPLICATIONS

This U.S. application was described and claimed in a PCT International application No. PCT/GB2007/050018, filed on 15 Jan. 2007, which claimed priority under 35 USC §119 to Great Britain application No. 0601075.5, filed on 19 Jan. 2006 and Great Britain application No. 0602394.9, filed on 7 Feb. 2006.

BACKGROUND OF THE INVENTION (1) Field of the Invention

The present invention relates to security systems, and in particular to a security system for an electrical device connected to a mains electricity supply.

(2) Description of Related Art

According to the British Crime Survey 2004/2005, electrical goods and cameras were taken in 24% of burglaries, mobile phones were taken in 16% and computers and computer equipment were taken in 15% (data taken from http://www.homeoffice.gov.uk/rds/pdfs05/burglary_0405.xls). Electrical goods such as televisions, video equipment, stereo equipment and computers are all commonly left connected to a mains electricity supply in a home or office. Although items such as digital cameras, laptop computers and mobile phones are normally battery-powered, they are typically charged up periodically from the mains.

It is known to superimpose data signals on a mains electricity supply. Early applications of such technology were mostly limited to items such as intercoms and baby alarms. More recently, Power Line Communications (PLC) technology has been developed to enable both broadband Internet access over a mains supply and the creation of local area networks (LANs) within buildings. The HomePlug (RTM) Alliance has developed a set of standards for local area networking across domestic power lines and has certified products from a wide variety of manufacturers. Chipsets for HomePlug devices are now readily and cheaply available, which makes networking in a home or office via a mains power supply affordable.

Current intruder alarms, which typically use sensors such as door switches and passive infrared (PIR) devices, are of limited use in environments normally accessible to the public, such as offices, shops, hotels, schools, colleges, museums and libraries. The physical locking devices sometimes used to secure electrical devices in these environments can be considered clumsy and unsightly. Furthermore, conventional movement sensors such as PIR devices can be either under-sensitive to the presence of an intruder, or over-sensitive to the movement of, for example, pets.

BRIEF SUMMARY OF THE INVENTION

According to a first aspect of the present invention, there is provided a security system for an electrical device connected to a mains electricity supply, the security system comprising:

a confirmation transmitter interposed between the electrical device and the mains electricity supply, the transmitter configured to send a confirmation message via the mains supply; and a control unit operatively connected to the mains supply, the control unit configured to receive the confirmation message;

wherein the control unit is configured to activate an alarm if the control unit does not receive the confirmation message.

Preferably, the confirmation transmitter is disposed at a connection unit for connecting the electrical device to the mains supply, and it is preferred that the connection unit comprises either an electrical plug or an electrical adaptor for adapting a mains socket to connect to more than one electrical device.

Preferably, the security system further comprises:

a receiver operatively connected to the electrical device; and a control transmitter at the control unit;

wherein the control unit transmitter is configured to send a request message to the electrical device via the mains supply; and the confirmation transmitter is configured to send the confirmation message in response to the request message.

For additional security, the system may comprise a receiver operatively connected to the electrical device, a transmitter at the control unit arranged to send an advertisement message to the electrical device via the mains supply and means for disabling the electrical device if the electrical device does not receive the advertisement message. This prevents the device from being used if it has been stolen.

It is preferred that the disabling means is not activated until an activating message has been sent from the control unit to the electrical device. Additionally, a deactivating message may be sent from the control unit to the device to deactivate the disabling means. Timing means may be provided to introduce a predetermined time delay between the electrical device not receiving the advertisement message and disabling the electrical device.

For additional security, it is preferred that the system further comprises means to encrypt the confirmation message. It is also preferred that the system further comprises means encrypt the request message and to send the request message periodically.

It is preferred that the security system further comprises detection means for detecting whether the electrical device is connected to the mains power supply, wherein the confirmation transmitter is configured to not send the confirmation message if it is detected that the electrical device is not connected to the mains power supply. The detection means may be arranged to detect a change in current taken by the electrical device or to detect a change in capacitance.

In one embodiment, the transmitter is operatively connected to a plurality of electrical devices.

It is possible for the confirmation transmitter and the control unit to each have a backup power supply independent from the mains supply.

It is possible that a user might want to disconnect an electrical device for legitimate reasons. To allow this, the security system may further comprise:

means to generate a disconnection message informing the control unit of a user's intention to disconnect the electrical device; and means to, on receipt of the disconnection message at the control unit, disable the alarm for the electrical device.

The security system may further comprise means to authorise a user to disconnect the electrical device, wherein the means to authorise the user is disposed at either the electrical device, between the electrical device and the control unit, or at the control unit. The means to authorise a user to disconnect the electrical device may include a number pad in which the user can enter a Personal Identification code, a swipe card, or biometric techniques. The user's data is then validated against a database, and the security system is disabled for that device assuming correct validation. The means to authorise a user may alternatively include identification of the electrical device. If a user has knowledge of the identification of the device, for example a swipe card or a PIN code identifying the device, then the user is authorised to disconnect it.

The security system may further comprise means to generate a reconnection message for sending to the control unit, the reconnection message being generated either automatically when the electrical device is reconnected to the mains electricity supply, or in response to an input from the user. Means may be provided to activate the alarm if a reconnection message has not been received at the control unit after a predetermined period of time from receipt of the disconnection message.

According to a second aspect of the present invention, there is provided a control unit for a security system, the control unit being operatively connected to a mains electricity supply, and comprising a receiver configured to detect a confirmation message sent via the mains supply from a confirmation transmitter interposed between an electrical device and the mains electricity supply, and further comprising alarm activation means to activate an alarm if the confirmation message is not received.

The control unit preferably comprises a transmitter, the transmitter configured to send a request message to an electrical device via the mains supply.

The control unit may comprise means to encrypt the request message, and may also comprise means to periodically send the request message.

According to a third aspect of the present invention, there is provided a confirmation transmitter constructed and configured to be interposed between an electrical device and a mains electricity supply, wherein the confirmation transmitter is configured to send a confirmation message via a mains supply to a remote control unit, to enable the remote control unit to activate an alarm if the confirmation message is not received.

Preferably, the confirmation transmitter further comprises a receiver configured to receive a request message sent via the mains supply from the remote control unit, wherein the confirmation transmitter is configured to send the confirmation message in response to the request message.

The confirmation transmitter may be configured to generate a specific confirmation message in response to a specific request message.

The confirmation unit may be formed as part of a connection unit for connecting an electrical device to a mains power supply. The connection unit may comprise means for connecting a plurality of electrical devices to the mains supply.

According to a fourth aspect of the present invention, there is provided an electrical device comprising:

connection means for connecting the electrical device to a mains power supply; and a confirmation transmitter associated with the connection means;

wherein the confirmation transmitter is configured to send a confirmation message via the mains supply to a remote control unit, to enable the remote control unit to activate an alarm if the confirmation message is not received.

Preferably, the connection means comprises the confirmation transmitter.

The electrical device may further comprise a receiver configured to receive a request message sent via the mains supply from the remote control unit, wherein the transmitter is configured to send the confirmation message in response to the request message According to a fifth aspect of the present invention, there is provided a security system for an electrical device connected to a mains electricity supply, the security system comprising:

a control unit operatively connected to the mains supply, the control unit configured to send periodic advertisement messages via the mains supply;

a receiver operatively connected to the electrical device, the receiver configured to receive the advertisement messages via the mains supply; and disabling means for disabling the electrical device if the electrical device does not receive the advertisement messages.

It is preferred that each advertisement message is directed to a specific electrical device connected to the mains electricity supply.

Preferably, the security system further comprises:

means to send an activating message from the control unit to the electrical device;

wherein the disabling means is not activated until the device has received the activating message.

It is also preferred that the security system comprises:

means to send a deactivating message from the control unit to the electrical device;

wherein the disabling means is deactivated when the device receives the deactivating message.

The security system may further comprise timing means, the timing means arranged to introduce a predetermined time delay between the electrical device not receiving the advertisement message and disabling the electrical device.

The advertisement message may be directed to a specific electrical device connected to the mains supply, and may be encrypted.

The security system may further comprise:

an intermediate transceiver disposed between the electrical device and the mains supply;

wherein the intermediate transceiver is configured to transmit the advertisement message to the receiver.

The intermediate transceiver may pass advertisement messages directly to the receiver, with only a physical layer translation to account for different electrical standards between the mains supply and the intermediate transceiver and between the intermediate transceiver and the receiver; or it may employ a separate communications protocol to send advertisement messages to the receiver.

The messages from the intermediate transceiver may be transmitted via either a power supply connection or a dedicated connection for transmitting messages.

According to a sixth aspect, there is provided an electrical device comprising:

means to connect the electrical device to a mains supply;

a receiver, the receiver capable of receiving an advertisement message sent from a remote control unit, either directly or via an intermediate transceiver;

disabling means for disabling the electrical device if the electrical device does not receive the advertisement message.

BRIEF DESCRIPTION OF THE DRAWING(S)

For a better understanding of the present invention and in order to show how the same may be carried into effect reference will now be made by way of example to the accompanying drawings in which.

DETAILED DESCRIPTION OF THE INVENTION

Figure 1:
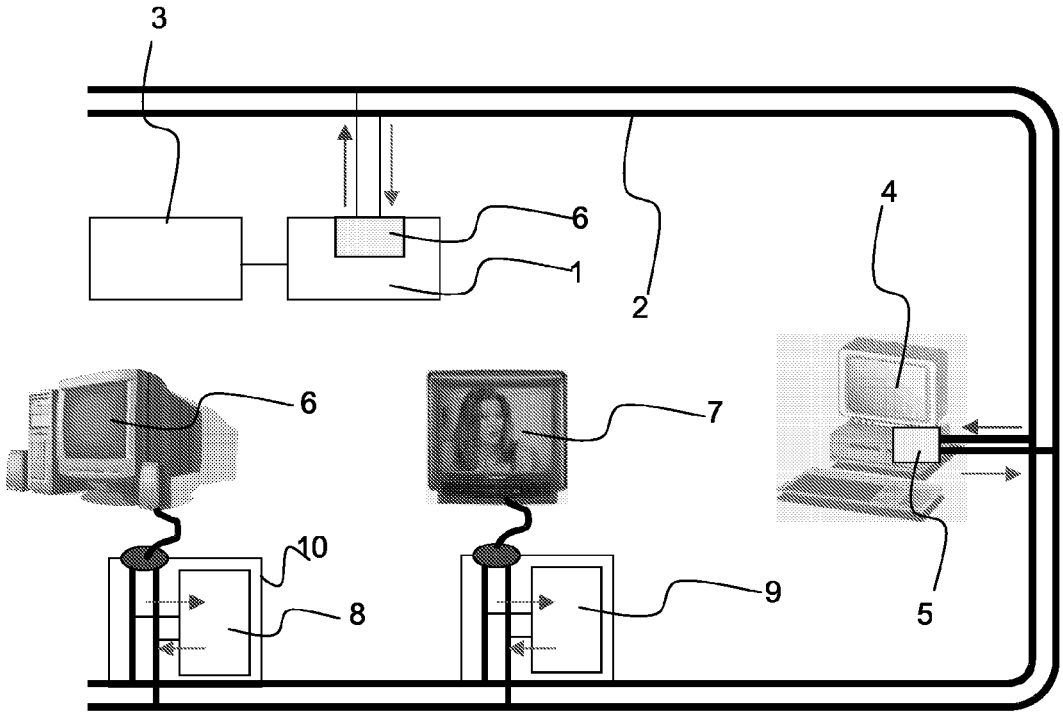
FIG. 1 shows schematically the security system according to a first specific embodiment.

According to the first specific embodiment, a control unit 1 is operatively connected to a mains electricity supply 2. The control unit 1 is powered by the mains supply 2 and is also configured to send and receive signals via the mains supply 2. The control unit is also connected to an alarm 3. At least one electrical device 4 is also connected to the mains supply 2. The electrical device can comprise any device connected to the mains supply 2, and will typically be computer equipment such as a PC or a printer, office equipment such as a data projector or laser printer, home entertainment equipment such as a stereo, television, DVD player, video cassette recorder and so on.

The electrical device 4 has a transceiver 5 that is configured to receive and transmit messages over the mains supply 2. The control unit 1 has a control unit transceiver 6 that is also configured to receive and transmit messages over the mains supply 2. The transceiver 6 comprises a transmitter and a receiver.

The control unit 1 checks periodically for the presence of the electrical device 4 using a technique similar to the known IP "ping". It generates a request message and transmits the message over the mains supply 2. The transceiver 5 of the electrical device 4 receives the request message and generates a confirmation message. The confirmation message is transmitted over the mains supply 2 and received by the control unit 1. In this way, the control unit 1 receives confirmation that the electrical device 4 is present and connected to the mains supply 2.

In the event that the electrical device 4 is unplugged from the mains supply 2, the transceiver 5 of the electrical device will be unable to send a confirmation message. The control unit 1 will be aware that the electrical device 4 is not present on the mains supply 2 if no confirmation message is sent in response to the request message. When no confirmation message is received by the control unit 1, the control unit activates the alarm 3, which may be a local alarm or may be linked to a local police station.

Typically, more than one electrical device is connected to the mains supply 2. Devices 6 and 7 are also connected. The control unit 1 sends request messages to each device 4, 6, 7 on the mains supply 2 and receives confirmation messages from each device 4, 6, 7. By assigning different identifiers for each device transceiver 5, 8, 9 the control unit 1 can identify precisely which devices 4, 6, 7 are connected to the mains supply 2 and which devices are not. Where several electrical devices are present, the control unit 1 has 'floor control'; that is to say, the order in which request messages are sent out and consequently confirmation messages are received is determined by the control unit 1.

The transceivers 5, 8, 9 associated with the electrical devices 4, 6, 7 may be disposed at different locations relative to the electrical device. These include the following:

Transceiver 5 may be built into electrical device 4.

A transceiver 8 may be disposed as part of a plug 10 that connects device 6 to the mains supply 2.

The transceiver may be disposed as part of an adaptor for adapting a mains socket to connect to more than one electrical device. In this way, by disposing the transceiver as part of, for example, a four-way adaptor, a single transceiver can be associated with several electrical devices.

The transceiver may be disposed as a unit between the plug of the electrical device and the wall socket, in the manner of a multi-way adaptor but with only one socket.

The transceiver may be disposed as a separate unit between the plug and the electrical device.

The transceiver may be disposed between the electrical device and another electrical device. For example, certain PCs draw power from the mains supply 2, with a further power cord connecting a monitor to the PC. If the transceiver is disposed in the power cord between the PC and the monitor, it will be impossible to disconnect the PC from the mains without also disconnecting the transceiver, and so the PC will be protected by the system. If the transceiver also contains means to detect the presence of the monitor, the monitor will be protected as well. If the plug 10 is removed from the mains supply 2 then the control unit 1 will detect the absence of the electrical device 6 and the alarm 3 will be activated.

Where the transceiver 8 is disposed as part of a plug 10, a thief may attempt to fool the control unit 1 by cutting the cable connecting the plug 10 to the electrical device 6. Various means can be used to detect whether the cable has cut. If cable cutting is detected, then the transceiver either stops sending the confirmation message, in which case the alarm 3 is activated, or sends an alarm message to instruct the control unit 1 to activate the alarm 3.

Means to detect whether the cable has been cut include:

i) Means to detect a change in the current taken from the mains supply 2 by the device 6. Modern electrical equipment is typically left in "standby" mode, drawing a small but measurable current, for extended periods when not in use.

ii) Means to detect a change in the capacitance of the mains cable to the device 6. This requires more sensitive electronics, but does not require the device to be left on standby.

Other ways that a thief may use to try to defeat the system include electronic means. For example, a thief may attempt to flood the system with data, in a manner similar to an Internet 'denial of service' attack. The effect of this is to prevent signals from getting to or from the transceivers. If this happens, the control unit 1 will no longer be able to detect the presence of a transceiver and the alarm 3 will be activated.

Alternatively, a thief may attempt to use a 'spoofing' device that would listen to the messages sent on the mains supply 2 and imitate the response of the transceivers 5, 8, 9. This would allow the thief to disconnect any of the electrical devices 4, 6, 7 with impunity as the control unit 1 would still be receiving confirmation messages sent by the spoofing device. To prevent this, it is preferred that the system uses messaging that follows an encrypted sequence, rather than sending and receiving the same "clear" messages each time.

Figure 2:
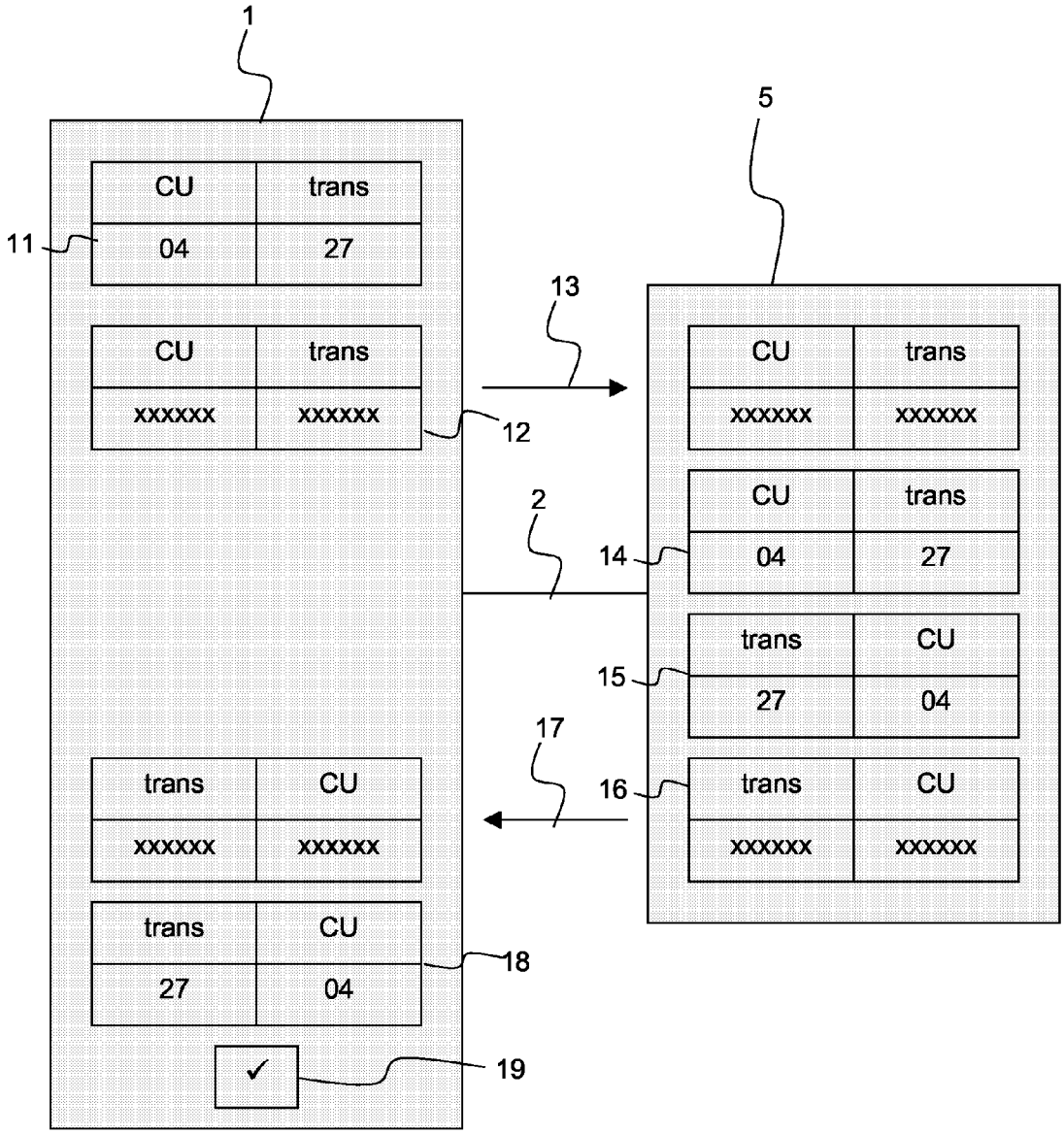
FIG. 2 shows a signalling diagram illustrating an example of signalling that may be used by the security system.

Referring to FIG. 2, the control unit 1 generates a request message 11. This request message is encrypted 12 and then sent 13 via the mains supply 2 to the transceiver 5 of the electrical device 4. The transceiver 5 decrypts 14 the request message and generates the confirmation message 15 in response to the request message 11. The confirmation message is then encrypted 16 and sent 17 back to the control unit transceiver 6. The control unit 1 decrypts the message 18, and if the message is confirmed as having come from the correct transceiver, the message is validated 19 and the alarm 3 is not activated.

It should be noted that it would be very difficult for a listening device to tell which confirmation message originated from which transceiver. Consequently, any spoofing attempt would have to imitate all of the transceivers 5, 8, 9 on the mains supply 2 rather than just one. The control unit 1 can be programmed to activate the alarm 3 if it receives two identical responses, since it can be configured to assume that one came from the transceiver 5 and the other from a spoofing device. Furthermore, the control unit 1 can be programmed to activate the alarm 3 if it receives an incorrect confirmation message.

Even in the event of a power cut, which may be accidental or caused deliberately by a thief, the system would maintain operation provided that backup power was provided to the control unit and transceivers. The backup power could be in the form of a battery or rechargeable battery, whereupon it would still be possible to transmit request and confirmation messages over the mains cables. Although an apparatus for measuring the current drawn by electrical device 6 would no longer function, it would still be possible to detect the presence of electrical device 6 by other methods, such as measuring the capacitance of the mains cable or the impedance between the live and neutral connections of electrical device 6. An "open circuit" reading would indicate that the unit has been unplugged, and cause the alarm to be activated.

There may be a requirement to allow an authorised user to temporarily disable the security system for a particular device. If, for example, the electrical device is a piece of hospital equipment, and an authorised user needs to unplug it to move it elsewhere, it would be unacceptable to allow them to disable the entire security system, and inconvenient for them to access the control unit to disable the alarm for that device. In order to allow an individual device to be moved, the transceiver may be connected to, or incorporate, an input device. Suitable input devices could include number pads for entering Personal Identification Numbers (PINs), card readers, and biometric sensors. An authorised person then uses the input device to show that they are authorised to move the equipment. Once the user's identity is validated against either a locally-held database or a central database associated with the control unit, the control unit will stop sending request messages to that electrical device, and will stop listening for confirmation messages from it. The device can then be unplugged and moved.

Typically, protection is automatically re-enabled for the electrical device when it is next connected to an environment where it is able to communicate with the control unit. If this does not happen within a pre-determined period of time, the control unit either activates the alarm or generates a message to inform staff that a device has been disconnected but not then re-connected within the permitted time. The security system may be configured so that authorised users may re-enable the protection for the electrical device manually.

According to a second specific embodiment, each electrical device is operatively connected to a transmitter only, which cannot receive signals from the control unit. The transmitter may be disposed at the device, at a plug, between the device and a plug, between the device and a second device, or alternatively the device may be interposed between the transmitter and the mains supply. The transmitter periodically sends out a confirmation message over the mains supply 2 to the control unit 1. If the electrical device is unplugged from the mains supply 2, then the transmitter cannot send confirmation messages over the mains network 2. The control unit 1 is configured to activate the alarm 3 if it stops receiving signals from the transmitter.

This embodiment is otherwise compatible with the first embodiment.

According to a third specific embodiment, each device comprises a receiver. The control unit 1 periodically sends out advertisement messages over the mains supply 2 similar to the request messages described for the first specific embodiment. If a device is unplugged or otherwise removed from the mains supply, the receiver associated with the device can no longer receive the advertisement messages. In this event, the receiver further comprises means to disable the device. If, for example, a television containing such a receiver were stolen, it would no longer function as it could not receive the advertisement messages from the control unit and so the device would be disabled.

It is apparent that not all electrical devices sold will be used as part of the security system of the third specific embodiment. Electrical devices must therefore be manufactured with the option of being used outside the security system environment. The default condition for all electrical devices as sold will be for the receiver to be installed in the device but factory-set to be deactivated. When a user wishes to protect the device, the user enters a security code provided with the device into the control unit. The control unit then sends an "activate" message via the mains supply to the device, which enables the receiver and causes it to begin the procedure of listening for repeated advertisement messages from the control unit. If the appliance is subsequently stolen, it will fail to receive the correct advertisement messages and will consequently be disabled.

A user may also deactivate the system by entering the security code and a deactivate command into the control unit. This allows the electrical device to be legitimately moved to a new environment.

Under certain circumstances, electrical devices might be legitimately used away from the security system environment for limited periods. For example, a data projector might be used at a trade show or at customers' premises for up to a few days at a time. In order to prevent such devices from being disabled when being legitimately used away from the security system environment, a time delay may be introduced between the device no longer receiving advertisement messages and the device being disabled. This delay period may be configured by the user from the control unit, typically when sending the "activate" message.

The same time delay mechanism may be used to apply the system of the third specific embodiment to portable equipment such as laptop computers, digital cameras and mobile phones. Provided that these devices are recharged periodically from a mains supply to which a correctly configured control unit is connected, and hence across which the correct advertisement messages are sent, and provided that they are recharged from this supply at intervals not exceeding the time delay specified, they will not be disabled. If the device fails to detect the correct advertisement messages after a period longer than the time delay specified, as will be the case if the device is stolen, it will then be disabled. If the only way to deactivate the disabling mechanism is by means of an encrypted deactivate command sent from the control unit, there will be no possibility of a thief finding a "back door" method to re-activate the device.

Where an electrical device is normally powered by a rechargeable battery and recharged via a separate charger, an intermediate transceiver may be incorporated into the charger for passing messages between the electrical device and the control unit.

Figure 3A:
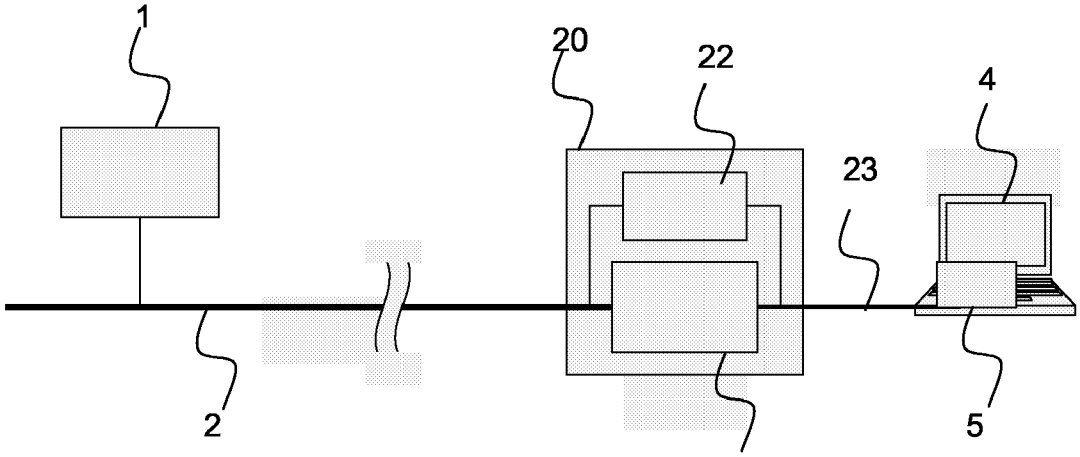
FIG. 3 shows schematically a security system adapted for use with an intermediate transceiver between the mains supply and an electrical device.

Referring to FIG. 3A, a charger 20 is used to connect the electrical device 4 to the mains supply 2 in order to recharge the batteries of the electrical device 4. The charger comprises a power supply unit 21 and an intermediate transceiver 22. The intermediate transceiver 22 can receive messages transmitted from the control unit 1 via the mains power supply 2 and forward these to the transceiver 5 of the electrical device Alternatively, the messages may be received by a receiver at the electrical device. The advertisement message therefore goes via the charger 20. In this instance, the advertisement message is unmodified except for modifications arising from a physical layer conversion between data sent over a mains power supply and data sent over a low voltage power supply. This allows the electrical device 4 to be recharged using any compatible charger 20. Alternatively, the intermediate transceiver 22 may implement a separate communications protocol between itself and the transceiver 5 of the electrical device 4. In this instance, the electrical device would only recognise an advertisement message sent from a specific charger 20, and so the device must be recharged from the specific charger in order to avoid being disabled.

Figure 3B:
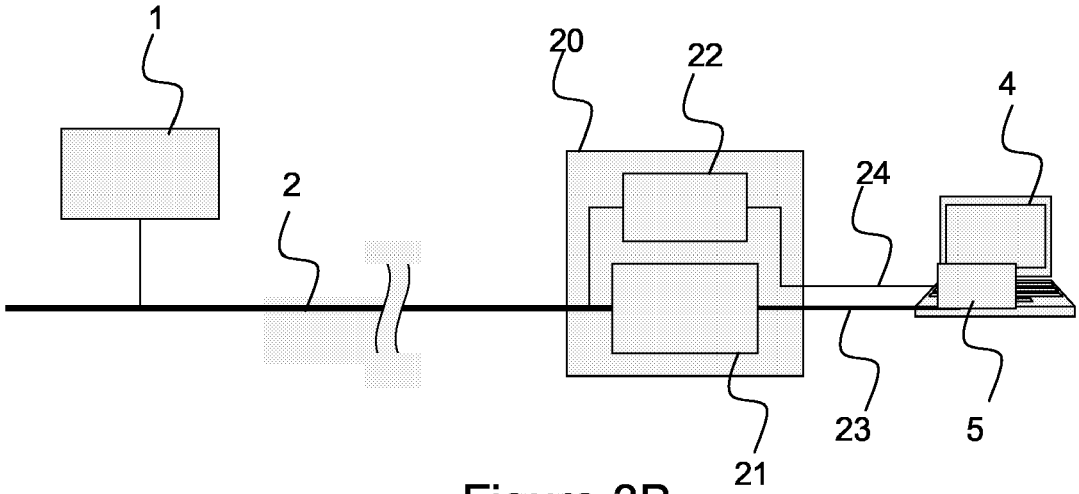

The intermediate transceiver 22 may pass messages between the charger 20 and the electrical device 4 via a low voltage power supply 23 that is also used to charge the batteries of the electrical device, as shown in FIG. 3A. Alternatively, the intermediate transceiver 22 may pass messages between the charger 20 and the electrical device 4 via a separate wire 24, as shown in FIG. 3B.

Where more than one electrical device is connected to the mains, a separate advertisement message is normally sent by the control unit specific to each device.

If the control unit of the third specific embodiment failed, all the devices that were protected by it would be disabled, either immediately or after the time delays specified for them. Consequently, means would typically be provided to back up the configuration of the control unit, in encrypted form, to a personal computer or other device. Means could also be provided to run multiple, redundant control units, with messages passed between them in order to verify their mutual presence and in order to synchronise their databases of electrical devices to be protected.

The third specific embodiment is compatible with the first specific embodiment. Where the features of both the first and third embodiments are implemented, the same control unit performs the functions of sending out advertisement messages to prevent devices from being disabled (which may also serve as request messages), and receiving confirmation messages from the electrical devices to prevent the alarm from being activated. The control unit may be implemented in a dedicated system or may be implemented in a personal computer or other device that has additional functions in addition to the control unit.

According to a fourth specific embodiment, each device is operatively connected to a transceiver, and the alarm may be activated if the transceiver does not send out the correct confirmation message or a confirmation message is not sent at all. Furthermore, the transceiver includes means to disable the electrical device if the transceiver does not receive the correct advertisement message (this can be the same as the request message) sent by the control unit 1. In this way, if an electrical device is stolen and removed from the mains supply 2, not only will an alarm 3 be activated, but also the electrical device will be disabled. This is similar to the third specific embodiment.

The control unit 1 periodically sends out advertisement messages over the mains supply 2 similar to the request messages described for the first specific embodiment. If a device is unplugged or otherwise removed from the mains supply, the transceiver associated with the device can no longer receive the advertisement messages. In this event, the transceiver further comprises means to disable the device. If, for example, a television containing such as receiver was stolen, it would no longer function as it could not receive the advertisement messages from the control unit.

A further level of security can be provided by providing each electrical device with a security code. This key is entered into the control unit 1, and the control unit 1 generates advertisement messages on the basis of the security code. The advertisement messages may also be encrypted to reduce the risk of eavesdropping to find the key.

According to a fifth specific embodiment, the security system is adapted for use over an electricity distribution network. The signals produced by most PLC technologies are blocked by transformers and electricity meters. This makes each home or office effectively act as a local area network for power line communications. Consequently, the messages sent and received by the control unit remain on the LAN. However, some recent techniques use VHF signals, which can pass through transformers. An implication of this is that a single control unit can be used for several premises.

Figure 4:
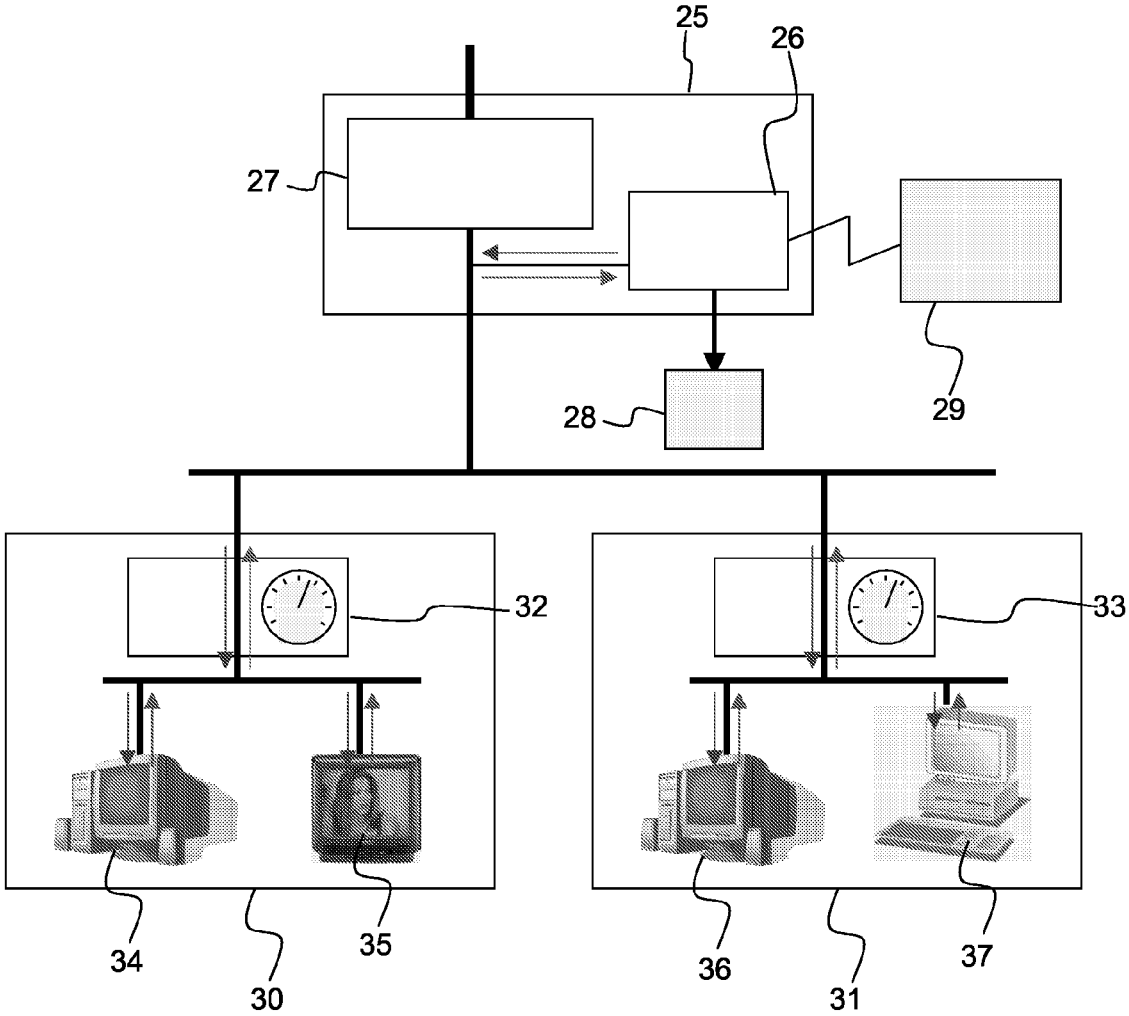
FIG. 4 shows schematically a security system adapted for use over an electricity distribution network.

Referring to FIG. 4, an area control unit 26 is located at an electricity substation 25, which includes a transformer 27. The area control unit 26 is connected to an alarm system 28, which may include a police alert system. The control unit 26 may also be connected to a customer billing system 29. The mains electricity supplies homes 30 and offices 31, each of which has its own electricity meter 32, 33. By using VHF signals, the area control unit 26 can send request messages to electrical devices 34, 35, 36, 37 in each home 30 or office 31, and the electricity meters 32, 33 will not disrupt the messages. A single area control unit 26 can be used to monitor devices in any of the premises that are supplied via the substation 25, and so each customer need not have their own burglar alarm. The security system may be run and billed by the electricity supplier as an added value service to its customers.

The fifth specific embodiment is in all other respects compatible with the first specific embodiment.

According to a sixth specific embodiment, the electrical device is itself an alarm device. For example, this could include a device for protecting a non-electrical item. The electrical device is connected to the mains supply and located on the item to be protected. The electrical device further comprises means to detect whether it has been moved, for example a motion sensor, a light sensor such as a photodiode or a bottom-mounted switch. If power to the device is removed then the control unit does not receive the confirmation message and so the alarm is activated. If the device is moved then the device transmits an alarm message via the mains supply to the control unit and the control unit activates the alarm. Alternatively, if movement is detected then the device can be configured to stop sending to confirmation message in which case the alarm will be activated.

It will be appreciated by those of skill in the art that various modifications may be made to the above described embodiments without departing from the scope of the present invention.

For example, the above description describes embodiments using an ac mains electricity supply. However, other electricity supplies are possible, including dc supplies. Telecommunications switches are often powered using −48v dc, and a system as described in any of the specific embodiments could be modified for use on such a system.

A further example of means by which the security system could be applied to dc supplies is in the trickle chargers or "battery conditioners" which are often left connected to collectors' cars for extended periods. A transceiver could be disposed at the trickle charger, with means to detect the current being drawn by the vehicle's battery. An abrupt change in the current drawn from the charger could be interpreted as an attempt to steal the vehicle, whereupon the transceiver would cease sending confirmation messages to the control unit and the alarm would sound.

The invention claimed is:

1. A security system for an electrical device connected to a mains electricity supply, the security system comprising:

a confirmation transmitter interposed between the electrical device and the mains electricity supply, the transmitter configured to send a confirmation message via the mains supply; and a control unit operatively connected to the mains supply, the control unit configured to receive the confirmation message;

wherein the control unit is configured to activate an alarm if the control unit does not receive the confirmation message.

2. A security system as claimed in claim 1 wherein the confirmation transmitter is disposed at a connection unit for connecting the electrical device to the mains supply.

3. A security system as claimed in claim 1 wherein the confirmation transmitter is disposed at a connection unit for connecting the electrical device to the mains supply and the connection unit comprises either an electrical plug or an electrical adaptor for adapting a mains socket to connect to more than one electrical device.

4. A security system as claimed in claim 1, wherein the security system further comprises:

a receiver operatively connected to the electrical device; and a control transmitter at the control unit;

wherein the control unit transmitter is configured to send a request message to the electrical device via the mains supply; and the confirmation transmitter is configured to send the confirmation message in response to the request message.

5. A security system as claimed in claim 1, wherein the security system further comprises:

a receiver operatively connected to the electrical device;

a transmitter at the control unit, the transmitter arranged to send an advertisement message to the electrical device via the mains supply; and disabling means for disabling the electrical device if the electrical device does not receive the advertisement message.

6. A security system as claimed in claim 5, further comprising:

means to send a deactivating message from the control unit to the electrical device;

wherein the disabling means is deactivated when the device receives the deactivating message.

7. A security system as claimed in claim 5, further comprising a timer, the timer arranged to introduce a predetermined time delay between the electrical device not receiving the advertisement message and disabling the electrical device.

8. A security system as claimed in claim 1, further comprising detection means for detecting whether the electrical device is connected to the mains power supply, wherein the confirmation transmitter is configured to not send the confirmation message if it is detected that the electrical device is not connected to the mains power supply.

9. A security system as claimed in claim 1, wherein the confirmation transmitter is operatively connected to a plurality of electrical devices.

10. A security system as claimed in claim 1, further comprising:

means to generate a disconnection message informing the control unit of a user's intention to disconnect the electrical device; and means to, on receipt of the disconnection message at the control unit, disable the alarm for the electrical device.

11. A security system as claimed in claim 10, further comprising means to authorise a user to disconnect the electrical device, wherein the means to authorise the user is disposed at either the electrical device, between the electrical device and the control unit, or at the control unit.

12. A security system as claimed in claim 10, further comprising means to generate a reconnection message for sending to the control unit, the reconnection message reactivating the alarm for the electrical device; and the reconnection message being generated either automatically when the electrical device is reconnected to the mains electricity supply, or in response to an input from the user.

13. A security system as claimed in claim 12, further comprising means to activate the alarm if a reconnection message has not been received at the control unit after a predetermined period of time from receipt of the disconnection message.

14. A security system as claimed in claim 1, wherein the security system further comprises:

a receiver operatively connected to the electrical device;

a transmitter at the control unit, the transmitter arranged to send an advertisement message to the electrical device via the mains supply;

disabling means for disabling the electrical device if the electrical device does not receive the advertisement message;

means to send an activating message from the control unit to the electrical device;

wherein the disabling means is not activated until the device has received the activating message.

15. A control unit for a security system, the control unit being operatively connected to a mains electricity supply, and comprising a receiver configured to detect a confirmation message sent via the mains supply from a confirmation transmitter interposed between an electrical device and the mains electricity supply, and further comprising alarm activation means to activate an alarm if the confirmation message is not received.

16. A control unit for a security system as claimed in claim 15, further comprising a transmitter, the transmitter configured to send a request message to an electrical device via the mains supply.

17. A control unit as claimed in claim 16, further comprising means to periodically send the request message.

18. A confirmation transmitter constructed and configured to be interposed between an electrical device and a mains electricity supply, wherein the confirmation transmitter is configured to send a confirmation message via a mains supply to a remote control unit, to enable the remote control unit to activate an alarm if the confirmation message is not received.

19. A confirmation transmitter as claimed in claim 18, further comprising a receiver configured to receive a request message sent via the mains supply from the remote control unit, wherein the confirmation transmitter is configured to send the confirmation message in response to the request message.

20. A connection unit for connecting an electrical device to the mains power supply comprising the confirmation transmitter as claimed in claim 18.

21. A confirmation transmitter as claimed in claim 18, further comprising a receiver configured to receive a request message sent via the mains supply from the remote control unit, wherein the confirmation transmitter is configured to generate and send a specific confirmation message in response to a specific request message.

22. An electrical device comprising:

connection means for connecting the electrical device to a mains power supply; and a confirmation transmitter associated with the connection means;

wherein the confirmation transmitter is configured to send a confirmation message via the mains supply to a remote control unit, to enable the remote control unit to activate an alarm if the confirmation message is not received.

23. An electrical device as claimed in claim 22, wherein the connection means comprises the confirmation transmitter.

24. An electrical device as claimed in claim 22, further comprising a receiver configured to receive a request message sent via the mains supply from the remote control unit, wherein the transmitter is configured to send the confirmation message in response to the request message.

* * * * *